US005904339A

United States Patent [19]

Flinn

[11] Patent Number: 5,904,339

[45] **Date of Patent: *May 18, 1999**

[54] MOBILE AUTOMOTIVE SERVICING APPARATUS

[75] Inventor: Henry I. Flinn, Pittsboro, N.C.

[73] Assignee: Mary C. Flinn, Pittsboro, N.C.

[21] Appl. No.: 08/974,168

[22] Filed: Nov. 19, 1997

Related U.S. Application Data

[ 60] Provisional application No. 60/031,316, Nov. 19, 1996.

[51] Int. Cl.[6] ..... E02C 3/00

[52] U.S. Cl. ..... 254/88; 254/90

[58] Field of Search ..... 254/88, 90, 91; 187/216, 221; 14/69.5, 71.7

[56] References Cited

U.S. PATENT DOCUMENTS

| | | | |
|---|---|---|---|
| 1,569,469 | 1/1926 | Elzey . | |
| 3,191,784 | 6/1965 | Wade | 254/88 |
| 3,804,206 | 4/1974 | Bubik | 254/88 |
| 3,931,895 | 1/1976 | Grimaldo . | |
| 4,120,485 | 10/1978 | McConnell | 254/88 |
| 4,238,114 | 12/1980 | Migliorati . | |
| 4,445,665 | 5/1984 | Cray . | |
| 4,724,875 | 2/1988 | Baldwin et al. . | |
| 4,901,980 | 2/1990 | Hansen | 254/88 |
| 5,141,371 | 8/1992 | Pish | 254/88 |
| 5,340,082 | 8/1994 | Holloway | 254/88 |

*Primary Examiner*—David A. Scherbel
*Assistant Examiner*—Lee Wilson
*Attorney, Agent, or Firm*—Pillsbury Madison & Sutro LLP

[57] ABSTRACT

A mobile automotive servicing apparatus is provided with wheel-carrying axle supporting a frame. A pair of ramps are pivotally mounted over the axle, each ramp having a slidably movable ramp extension associated therewith in telescoping relationship. An air compressor is provided on the frame for moving the ramps between horizontal and tilted positions. The frame also supports a compartment for storing tools, supplies and equipment for servicing a vehicle driven onto the ramps when they are tilted and then moved into serving position when the ramps are disposed horizontally.

2 Claims, 1 Drawing Sheet

MOBILE AUTOMOTIVE SERVICING APPARATUS

This application claims the benefit of U.S. Provisional Application No. 60/031,316 filed Nov. 19, 1996.

BACKGROUND OF THE INVENTION

1. Field of the Invention

The present invention relates to a mobile automotive servicing apparatus which is transportable so as to service vehicles at any convenient location.

2. Prior Art

Mobile vehicle serving systems are generally known. Examples are the apparatus disclosed in U.S. Pat. Nos. 4,724,875—-Baldwin, et al. and 4,445,665—-Craig. The present invention is an improvement over systems of the type disclosed in the aforesaid patents.

SUMMARY OF THE INVENTION

The mobile automotive servicing apparatus according to the present invention includes a pair of spaced ramps which are pivotally mounted to a frame of the servicing apparatus above an axle for wheels which permit the apparatus to be transported. Each ramp receives in telescoping relationship an additional ramp which can be slid longitudinally relative to its associated ramp so as to be substantially coextensive therewith or to form an extension of the pivotally mounted ramp. An air cylinder is joined to the pivotally mounted ramps. When the slidably movable ramps are positioned as extensions of the pivotally mounted ramps, the air cylinder is operative to tilt the entire ramp assembly so as to move the distal ends of the slidable ramps into engagement with the ground. The vehicle being serviced can then be driven onto the tilted ramps at which time the air cylinder is actuated to return the ramps to a horizontal plane. At that time the vehicle can be moved forwardly on the ramps into a servicing position. The frame of the servicing apparatus is provided with adjustable supports at the forward and rear ends of the pivotally mounted ramps. These supports are actuated so as to engage the ground when a vehicle is being serviced so as to support the weight of the servicing apparatus and the vehicle being serviced. The frame also supports a storage compartment at its forward end, the compartment containing the tools, supplies and equipment necessary for servicing the vehicle.

BRIEF DESCRIPTION OF THE DRAWINGS

The invention now will be described in further detail with respect to the accompanying drawings wherein.

DETAILED DESCRIPTION OF PREFERRED EMBODIMENTS OF THE INVENTION

In the embodiment illustrated in the accompanying drawings, the apparatus is a trailer arrangement which is towed to the location where the servicing is to be performed.

It will be understood, however, that instead of a trailer, the servicing components to be described can be mounted on the bed of a truck so that the apparatus is self-propelled.

Figure 1:
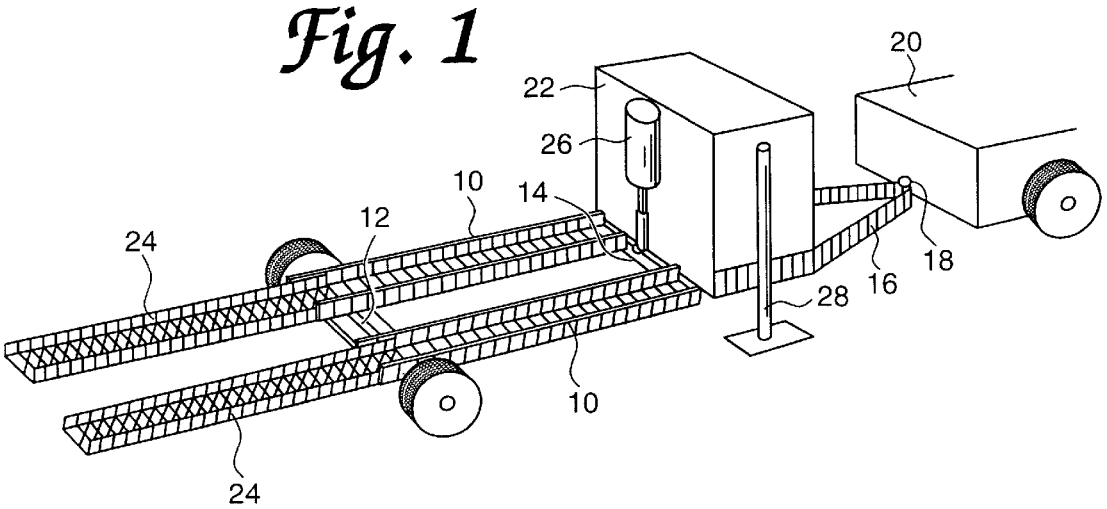
FIG. 1 is a perspective view of the mobile automotive servicing apparatus having its slidable ramps positioned as extensions of the pivotally mounted ramps.

The trailer shown in FIG. 1 includes a pair of spaced, fixed ramps 10 each pivotally supported at one of its ends on an axle 12. The opposite ends of the ramps rest on one or more frame members 14 which extend transversely of the trailer's longitudinal axis in parallel with the axle. A conventional V-shaped yoke 16 projects forwardly of the frame member(s) to a conventional receiver 18 for a ball hitch mounted to the rear of a towing vehicle 20.

A storage compartment 22 is located at the forward ends of the fixed ramps. The compartment contains such implements as an air compressor, generator, tools and automotive servicing supplies.

An additional pair of ramps 24 are associated in telescopic relationship with the respective fixed ramps so as to be slidably movable relative thereto between a retracted position, in which they rest substantially entirely on the fixed ramps, and an extended position, as shown in FIG. 1, in which they project rearwardly from the trailer.

Figure 2:
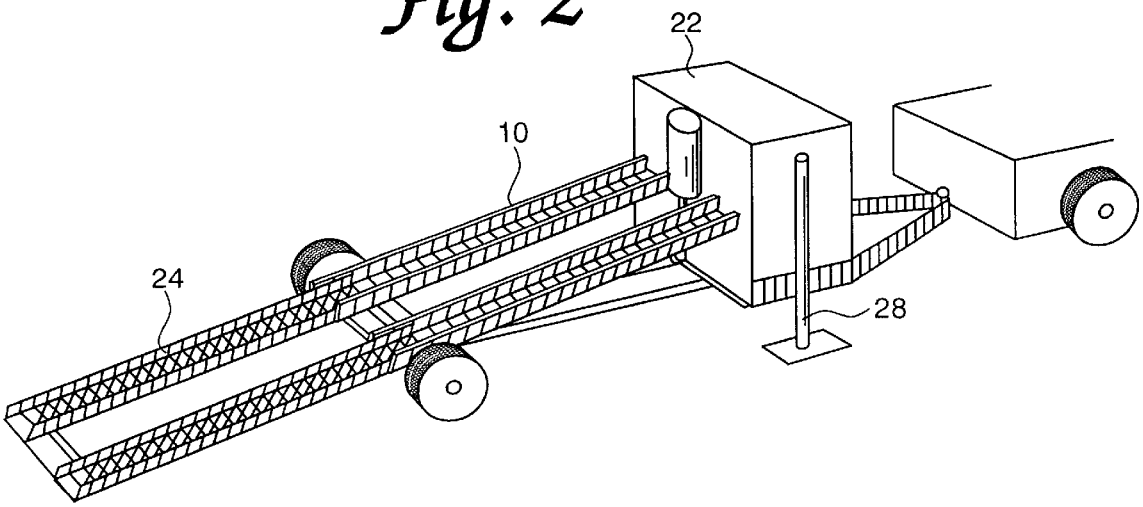
FIG. 2 is a perspective view of the servicing apparatus with the ramps tilted in a position in which a vehicle can be received for servicing, or a serviced vehicle can be discharged from the apparatus.

An air cylinder 26, associated with the compressor, is operatively connected with the forward ends of the fixed ramps. The cylinder is selectively connected to hydraulic devices (not shown) to lift the forward ends of the fixed ramps thereby tilting the ramps until the rearwardly projecting free ends of the slidable ramps engage the ground (FIG. 2). In this position a vehicle can be driven up the ramps to a point where the air cylinder's control of the hydraulic devices permits the ramps to return to the horizontal position. When the vehicle on the ramps is so oriented, it is suitably positioned for servicing, e.g., oil change, lubrication or mechanical repairs requiring access to the underside of the vehicle.

The forward outside portions of the trailer are provided with vertically displaceable support elements 28 each of which can be locked in a retracted position during transport and in an extended ground-engaging position when the trailer is in the desired location for servicing a vehicle. In the latter position, the support elements bear the weight of the trailer and the vehicle being serviced so that, if desired, the towing vehicle can be disconnected from the trailer.

Figure 3:
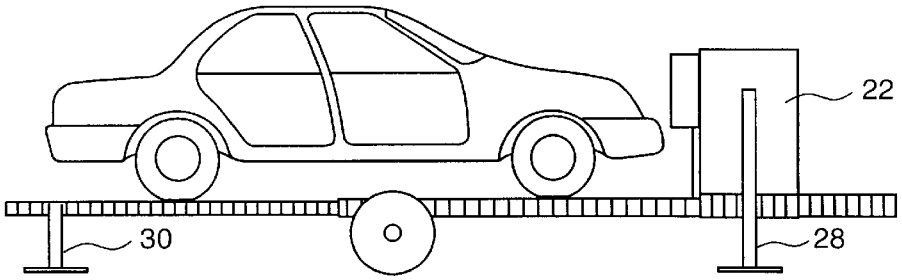
FIG. 3 is a side elevational view of a vehicle being positioned for servicing.

Similarly, as shown in FIG. 3, the rear ends of the slidable ramps also are provided with vertically displaceable support elements 30 to prevent tilting of the ramps when a vehicle is loaded thereon for servicing.

Preferably, the support elements which have been described are operatively connected to the compressor stored in compartment 22.

When the servicing is completed, the rear support elements 30 are retracted and the air cylinder 26 is actuated to tilt the ramps 10 and 24 until the rear ends of the slidable ramps 24 engage the ground. In that position, the vehicle can be rolled off the ramps. The ramps then are tilted to the horizontal, and the slidable ramps 24 are moved forwardly until they rest substantially entirely on the fixed ramps 10.

Of course, in addition to customarily required running lights, the trailer just described may be provided with suitable lighting elements and electrical outlets connected to the generator to permit specific areas of the vehicle being serviced to be properly illuminated.

While the axle 12 illustrated in FIG. 1 is provided with wheels rotatable about the axle's longitudinal axis, it should be understood that the wheels can be arranged to rotate about an axis vertically offset from a cross-member which pivotally supports the rear ends of the fixed ramps. Such an arrangement provides increased clearance between the ground and the underside of the trailer thereby facilitating servicing of the vehicle.

Additionally, channel rails can be provided on the underside of the trailer to receive a mechanic's sliding bed.

What is claimed is:

1. A mobile automotive servicing apparatus comprising:

a frame;

a wheeled axle supporting the frame and permitting the frame to be transported from place to place;

a first pair of spaced ramps pivotally mounted to the frame above the axle;

a second pair of ramps each being slidably associated in telescoping relationship with a respective pivotally mounted ramp, the slidably movable ramps being selectively displaced between positions where they are coextensive with or extensions of their respective pivotally mounted ramps;

support devices joined to the frame at locations adjacent forward ends of the pivotally mounted ramps and to rear ends of the slidably movable ramps, said support devices being selectively operable to engage the ground to thereby bear the weight of the servicing apparatus and any vehicle positioned on the ramps when they are in a horizontal position; and an air cylinder associated with the pivotally mounted ramps to selectively simultaneously displace them between horizontally disposed and inclined positions.

2. An apparatus according to claim 1, further comprising a storage compartment mounted on said frame for containing tools, supplies and equipment for servicing a vehicle.

* * * * *